United States Patent [19]

Bifulco

[11] 4,088,326

[45] May 9, 1978

[54] KNEE HOLDER FOR GOLFERS

[76] Inventor: John M. Bifulco, 911 E. 34th St., Erie, Pa. 16503

[21] Appl. No.: 715,049

[22] Filed: Aug. 17, 1976

[51] Int. Cl.[2] ..... A63B 69/36

[52] U.S. Cl. ..... 273/188 R; 273/187 R

[58] Field of Search ..... 273/188, 189, 187, 187 R, 273/183 B; 128/134; 119/128; 35/29 A

[56] References Cited

U.S. PATENT DOCUMENTS

| | | | |
|---|---|---|---|
| 858,633 | 7/1907 | Smith | 128/134 X |
| 1,279,924 | 9/1918 | Smith | 273/189 R |
| 1,677,728 | 7/1928 | Robinson | 273/188 A |
| 2,450,162 | 9/1948 | Promen | 128/134 X |
| 3,423,094 | 1/1969 | Auslander et al. | 273/188 R X |

*Primary Examiner*—George J. Marlo

*Attorney, Agent, or Firm*—Charles L. Lovercheck

[57] ABSTRACT

A golf practice device for holding the golfers knees in proper relationship throughout his swing of the golf club. The device includes two rigid, rectangular Knee-engaging members connected together by a flexible cord. One of such plates is located on the inside of each of the golfer's legs at the knee area. Three Knee-encircling straps are attached to each plate to secure same to the golfer's leg.

1 Claim, 6 Drawing Figures

KNEE HOLDER FOR GOLFERS

GENERAL DESCRIPTION OF THE INVENTION

Professionals in the game of golf have emphasized the importance of a proper rhythm, grip, and stance during the stroke, and of great importance, the position of the knees from the time the golfer addresses the ball until he completes the "follow through" after striking the ball. This coordination can best be acquired by keeping the knees locked in position (pulled toward each other) at the address, so that the arms, hands, body and knees, during the entire stroke, will work together to give increased power and accuracy to the stroke. I have devised the present device which may be attached to the knees of the player to aid a person in keeping his knees locked in position as he addresses the ball, just prior to the backswing. Using the device while practicing or when playing the game, a person will develop the habit of keeping his knees locked at address of the ball, which will aid him in grooving his stroke, improving his game, and imparting additional power to the ball during the correct position of the knees throughout the golf swing.

REFERENCE TO PRIOR ART

Various types of stance correction devices have been suggested. For example: U.S. Pat. No. 423,094 and U.S. Pat. No. 1,677,128 show golf stance correcting devices. However, none of these patents propose supporting the knees of the golfer in fixed space relation to each other.

OBJECTS OF THE INVENTION

It is the object of my invention to provide a device which is adjustable to fit and attach just below the knees of the person which may easily be applied, thereby keeping the knees in proper position without hindering of the proper knee action during the swing.

Another object of the invention is to provide in a golf training device means for readily attaching and detaching the device at the knees.

With the above and other objects in view, the present invention consists of the combination and arrangement of parts hereinafter more fully described, illustrated in the accompanying drawings and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
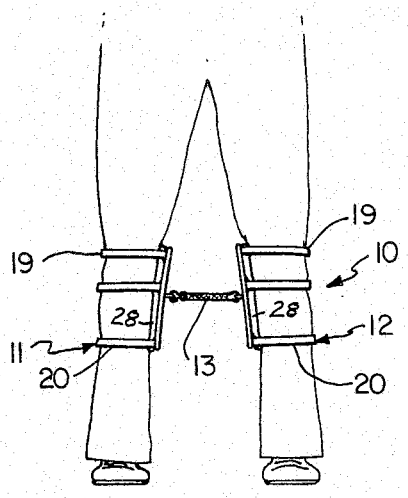
FIG. 1 is a front view of the golf practice device according to the invention shown supported on the knees of a person.
Figure 2:
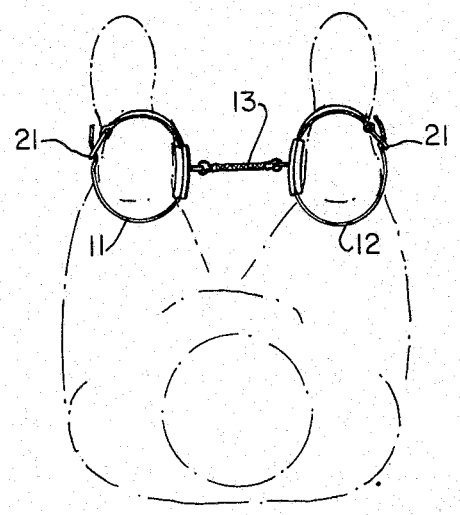
FIG. 2 is a top view of the golf practice device showing the knees of the person in phantom with the golfer in a sitting position.
Figure 3:
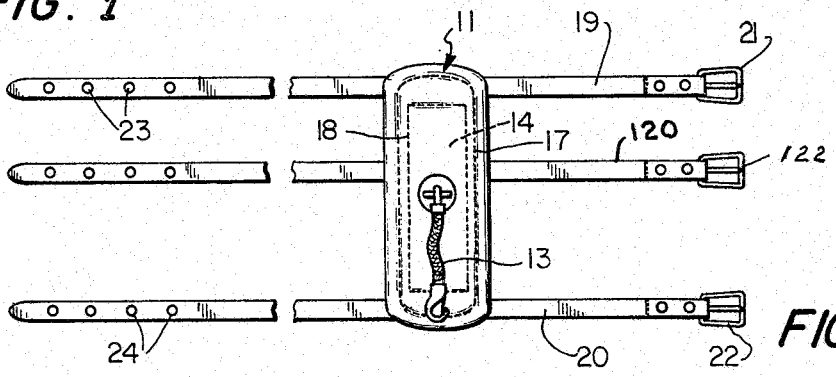
FIG. 3 is a view of one of the leg holders of the device.
Figure 4:
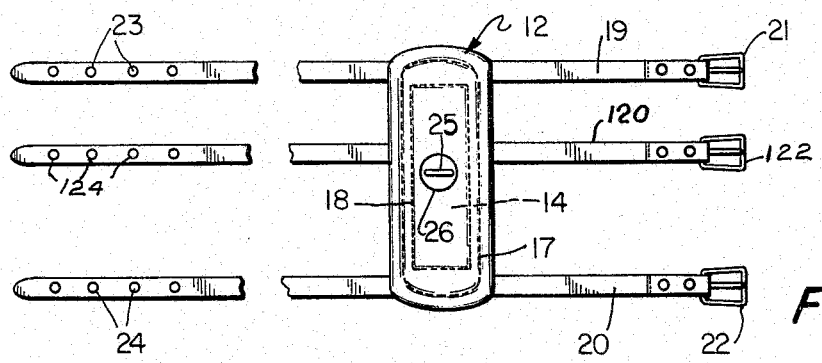
FIG. 4 is a view of the other leg holder of the golf practice device.
Figure 5:
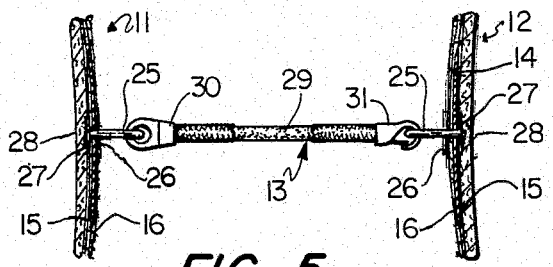
FIG. 5 is a cross-sectional view taken on line 5—5 of FIG. 4.
Figure 6:
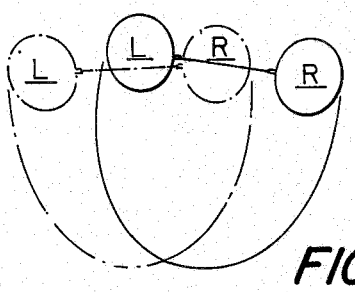
FIG. 6 shows the movement of the golfers knees throughout his swing of the club.

Now, with more particular reference to the drawings, a golf practice device 10 is shown made up of a first knee encircling device 11 and a second knee encircling device 12, connected together by a flexible member 13.

Each knee encircling device is made up of a relatively rigid plate 14 sandwiched between the sheets 15 and 16. The sheets 15 and 16 may be made of leather, sheet plastic material, webbing or any other suitable material. The sheets will be stitched, soncially welded, or attached together by any other suitable fastening means. Foam plastic may be attached to the leg side to add comfort. The sheets will be stitched together along the lines 17 and 18 and stitched along the lines shown to straps 19, 20, and 120. Straps 19, 20, and 120 will be of sufficient length to extend around the legs of an adult individual and each strap 19, 20, and 120 has a buckle 21, 22, and 122, secured to the end of the strap in a conventional manner and having holes 23, 24, and 124 in the opposite end for receiving the tongues of the buckles.

The knee encircling device 12 has an eyelet 25 extending through it with the eye of the eyelet engaging the washer 26. The eye extends through the rigid plate 14 and through the sheets 15 and 16 and through the washer 27 which may be received in recess 28 holding the two washers together and holding the eyelet 25 to the knee encircling member. Washers 26 and 27 distribute the force exerted by the eyelet on the leather and prevent the eyelet from deforming the leather. The knee encircling device 11 has similar structural details as indicated.

The flexible member 13 has an intermediate cord portion 29 connected to the end members 30 and the snap 31. This snap 31 is received in the eyelet 25 and the end member 30 is received in eyelet 25 on the encircling member 11. The flexible member 13 may be slightly resilient in order to insure better comfort of the golfer.

The golfer may disconnect the snap 31 from the eyelet 25 so that his legs are free for walking. He may fix the leg insertion members 10 and 11 to his legs while either in a standing postion or in a sitting position. Foam 28 may be cemented in place in the side.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A golf practice device comprising, two knee-engaging members, each said knee-engaging members comprising two sheets of flexible material, a generally rectangular, relatively flat rigid plate sandwiched between each two said sheets and having a substantial length and width to make said knee engaging members generally rigid, means securing said sheets together around the outside edges of said generally rectangular member, an eyelet fixed to each said plate and extending through one said sheet member, three spaced leg encircling straps attached to a sheet member adjacent each said plate, a buckle on an end of each said strap, one said strap on each said sheet being attached to said sheet adjacent each end thereof and the other said strap being attached to said sheet between the said eyelet thereon and to another said strap, one said strap being adapted to encircle the said leg of the said golfer below his said knee joint and the two other straps being adapted to encircle the leg above the said knee joint whereby said eyelet is supported at said knee joint and a flexible member attached to each said eyelet for limiting the movement of said relatively rigid plate members and the knees of said golfer away from each other during the swing of his golf club.

* * * * *